US007694961B2

(12) United States Patent
Mueller

(10) Patent No.: US 7,694,961 B2
(45) Date of Patent: Apr. 13, 2010

(54) STACK-LIKE ARRANGEMENT OF FLAT OBJECTS AS WELL AS METHOD AND DEVICE FOR FORMING THE ARRANGEMENT

(75) Inventor: Erwin Mueller, Duernten (CH)

(73) Assignee: Ferag AG, Hinwil (CH)

( * ) Notice: Subject to any disclaimer, the term of this patent is extended or adjusted under 35 U.S.C. 154(b) by 20 days.

(21) Appl. No.: 12/018,639

(22) Filed: Jan. 23, 2008

(65) Prior Publication Data

US 2008/0315509 A1 Dec. 25, 2008

(30) Foreign Application Priority Data

Jan. 26, 2007 (CH) ..... 0128/07

(51) Int. Cl.
*B65H 29/38* (2006.01)
*B65H 31/00* (2006.01)

(52) U.S. Cl. ..... 271/177; 271/207; 271/213; 414/790.7; 414/791.2

(58) Field of Classification Search ..... 271/207, 271/213, 177; 414/790.7, 791.2
See application file for complete search history.

(56) References Cited

U.S. PATENT DOCUMENTS

| | | | | |
|---|---|---|---|---|
| 3,379,320 | A | 4/1968 | Loach et al. | |
| 3,860,127 | A | 1/1975 | Fassman | |
| 3,866,905 | A * | 2/1975 | Trogan et al. | 271/181 |
| 3,915,316 | A * | 10/1975 | Pomara, Jr. | 414/789 |
| 5,485,989 | A | 1/1996 | McCay et al. | |
| 5,653,574 | A | 8/1997 | Lin | |
| 6,398,204 | B1 | 6/2002 | Keane et al. | |
| 6,997,454 | B2 * | 2/2006 | Antonelli et al. | 271/214 |
| 2002/0089115 | A1 * | 7/2002 | Keane et al. | 271/177 |
| 2004/0084827 | A1 | 5/2004 | Takamura | |

FOREIGN PATENT DOCUMENTS

| | | |
|---|---|---|
| DE | 32 38 655 A1 | 4/1968 |
| DE | 1 761 487 | 7/1971 |
| GB | 435333 | 9/1935 |
| JP | 60-15352 | 1/1985 |
| JP | 7-304550 | 11/1995 |

* cited by examiner

*Primary Examiner*—David H Bollinger
(74) *Attorney, Agent, or Firm*—Rankin, Hill & Clark LLP

(57) ABSTRACT

A stack-like arrangement of printed products with folded edges, in which arrangement the printed products are all arranged with identical orientation, has an increased stability, if it comprises stack sections, within which the folded edges of the printed products indeed lie on top of each other, but wherein the stack sections are arranged displaced in relation to each other, such that the stack sections with folded edges protruding from the arrangement alternate with stack sections with edges opposite the folded edges protruding from the arrangement.

17 Claims, 4 Drawing Sheets

Fig.1
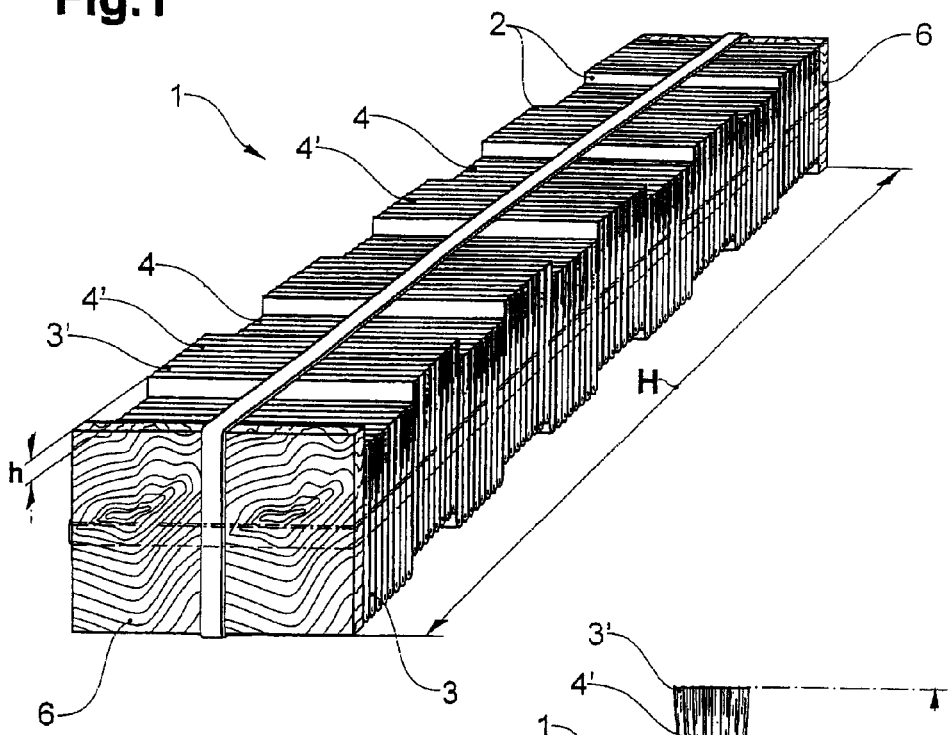
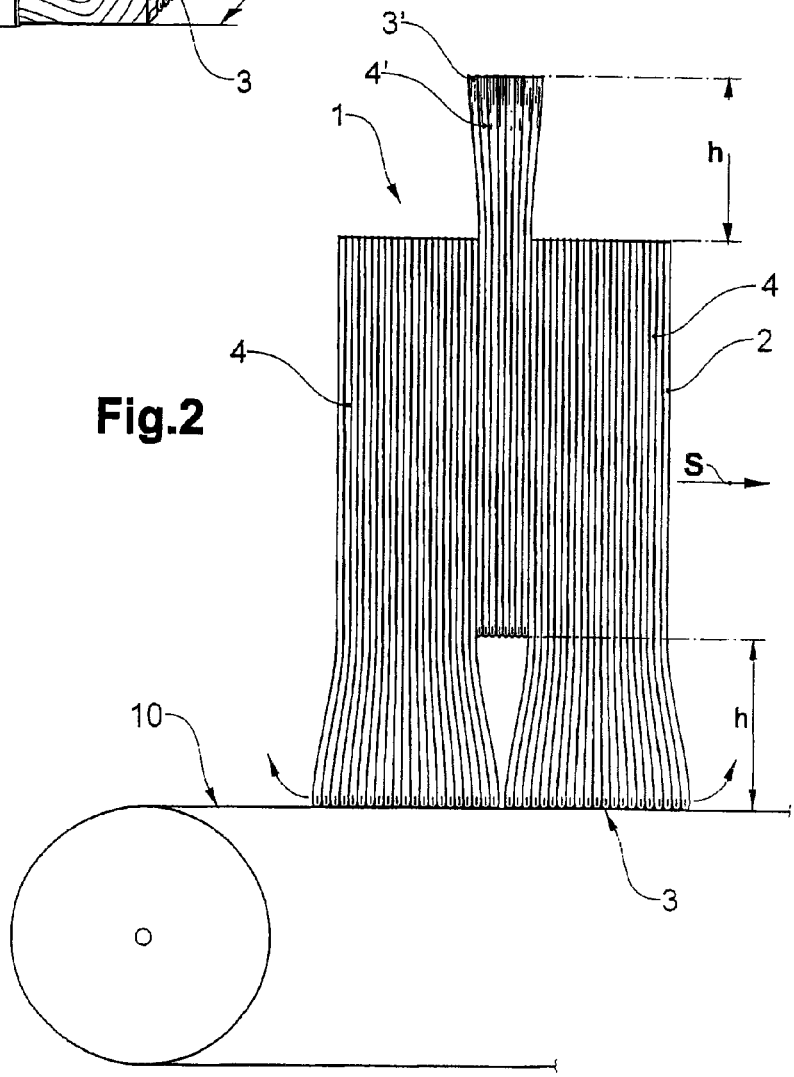
Fig.2

STACK-LIKE ARRANGEMENT OF FLAT OBJECTS AS WELL AS METHOD AND DEVICE FOR FORMING THE ARRANGEMENT

The invention is in the field of the further processing of flat objects, in particular printed products. The invention relates to a stack-like arrangement of the objects as well as a method and a device for forming such a stack-like arrangement. In the stack-like arrangement the flat objects are arranged substantially in parallel and closely adjacent to one another.

Stacks of flat objects, in particular of rectangular or square printed products such as newspapers, magazines or brochures are not only formed for transport and shipment but also for intermediate storage of the objects. In the stacks the format of all objects is substantially identical and they lie aligned and closely adjacent to one another. In the case of newspapers and magazines the stacks, for shipment, have a stack height (stack extension in transverse to the flat extension of the printed products, or stack extension normal to the plane of the flat objects), as known, which is of a length similar to the lengths and breadths of the printed products. For their stabilisation these stacks are e.g. strapped with a plastic tape and thus also pressed together and/or they are wrapped with plastic film. For an intermediate storage of printed products, e.g. inserts, which are printed in a first point in time and e.g. folded and stapled and added to another printed product in a second, later point in time, bar-like stack formations are usual, in which the stack height is substantially larger than the lengths and breadths of the printed products and which, when being formed and usually also when being stored are positioned with an approximately horizontal alignment of the stack height (horizontal stack orientation). This kind of stack comprises so-called end plates (e.g. wooden boards) on its two ends for stabilisation and is usually strapped once or twice with plastic tape.

The stacking and handling of stacks is largely unproblematic, providing that the objects to be stacked are of a constant thickness over their entire expanses. If this is not the case the stacks begin to be unstable from a small height and cannot be re-stabilised by strapping, to some extent not even if the strapping is applied to the stack with a high tension. This problem particularly develops for folded or stapled printed products, which include a folded-edge-region, which is thicker than the other regions of the printed product, in particular thicker than the region opposite the folded edge.

For forming stacks of printed products with an edge region, which comprises a greater thickness than the other regions, i.e. stacks of e.g. folded or stapled printed products, it is known to pivot the printed products in relation to one another from superposed stack sections by 180°, around a stack axis parallel to the stack height, such that the thicker edge regions of the printed products are arranged in a stack section on one side of the stack and in the two adjacent stack sections on the opposite sides of the stack. Hereby the stack sections can comprise all the more printed products the smaller the difference in thickness between the folded-edge-region and other regions of the printed products is. Stacks formed in the named manner are called cross stacks. Cross stacks of printed products with a thicker edge region are relevantly more stable than stacks of the same printed products, in which all printed products are orientated identically and thus may be of a larger stack height.

Cross stacks are advantageous, where the stacked objects are removed by hand, as the additional effort, which is necessary to turn every second stack section, for all objects to have the same orientation, is negligible for a person selling the printed products individually or feeding them into further processing (e.g. feeder) in sections. If the stacked objects are to be automatically singularised and fed into further processing with a continuous identical orientation the handling of cross stacks is considerably more sumptuous. For this reason it has so far, in the further processing of printed products, not been usual to use cross-stack-like formations for the intermediate storage of printed products to be automatically singularised later. Generally the stacks mentioned further above are not cross stacks but stacks in which all printed products are orientated identically.

The invention has the object to create a stack-like arrangement of flat objects with a first edge, wherein the first edge may differ from the other edges in that the edge region of the first edge is thicker than the regions of the other edges. It is an object of the invention to provide a stack-like arrangement which is at least as stable as corresponding cross stacks, wherein the objects in the inventive stack-like arrangement are, however, all identically orientated, i.e. such, that the first edges are all arranged on the same stack side. Furthermore it is the object of the invention to create a method and a device for forming the stack-like arrangement.

This object is achieved by the stack-like arrangement of flat objects and by the method and the device for forming the stack-like arrangement, as they are defined in the claims.

In the stack-like arrangement according to the invention the flat objects all have the same orientation, i.e. the same edges are located on the same side of the stack, and in particular the first edges of all objects are located on the same side of the stack. The objects are, however, arranged in a displaced or offset manner in transverse to the stack height (stack orientation) and in transverse to the first edge, such that in alternating stack sections the first edges or the second edges lying opposite the first edges protrude slightly on one or the other side of the stack, respectively. Within the stack sections the first edges lie on top of each other, if the section comprises a plurality of objects. Stack sections with only one object are, however, also conceivable.

The stack sections of the stack-like arrangement according to the invention are thus arranged in relative displacement to one another, wherein the degree of the relative displacement of the stack sections to one another is dependent on the characteristics of the first edges, in particular on the breadth in transverse to the first edge of an edge region in which a difference in thickness is still relevant to the stack. The thickness of the stack sections or the amount of objects per section is dependent on the difference in thickness between the region of the first edge and the other regions of the flat objects, wherein all sections of a stack may be of the same thickness or comprise different thicknesses. Particularly advantageous are the stacks, in which the stacks section with protruding thicker edge regions are larger than the stack sections, in which the edge regions opposite the thicker edge regions protrude from the stack.

The method and device for forming the stack-like arrangement according to the invention differ from known methods and devices for forming stacks, in which all flat objects have an identical orientation (not cross stacks), in that the objects, when being fed to the growing stack-like arrangement, are arranged to be displaced in relation to one another in sections in transverse to the height or orientation of the stack and in transverse to the first edge and in that, for forming of this displacement, a correspondingly controlled movable displacing means is provided.

The stack-like arrangement according to the invention is especially suited for printed products with an edge distinguished by greater thickness. These are in particular printed products folded once or twice or printed products stapled in a fold, e.g. newspapers, magazines or brochures. The magazines or brochures e.g. consist of sheets folded inside each other and are possibly stapled. The newspapers are folded once (tabloid) or twice, wherein the first edge is the edge of the second fold. This kind of printed product is usually rectangular or square, which is, however, not a condition to the stack-like arrangement according to the invention.

It shows that stack-like arrangements according to the invention are in particular suited to stapled printed products, the folded edges of which do not inherently have a stack-relevant larger thickness, in which, however, the stapling, due to its additional thickness, influences the stacking negatively, i.e. makes the stack unstable or restricts the possible stack height respectively.

Exemplified embodiments of the stack-like arrangement of flat objects as well as the method and the device for its forming are described in detail in connection with the following figures. Hereby FIG. 1 shows a stack-like arrangement according to the invention, which arrangement comprises end plates and is strapped with a strapping tape;

FIG. 2 shows a detail of the stack-like arrangement according to FIG. 1 in a larger scale and viewed in transverse to the displacement of the stack section;

Figure 3:
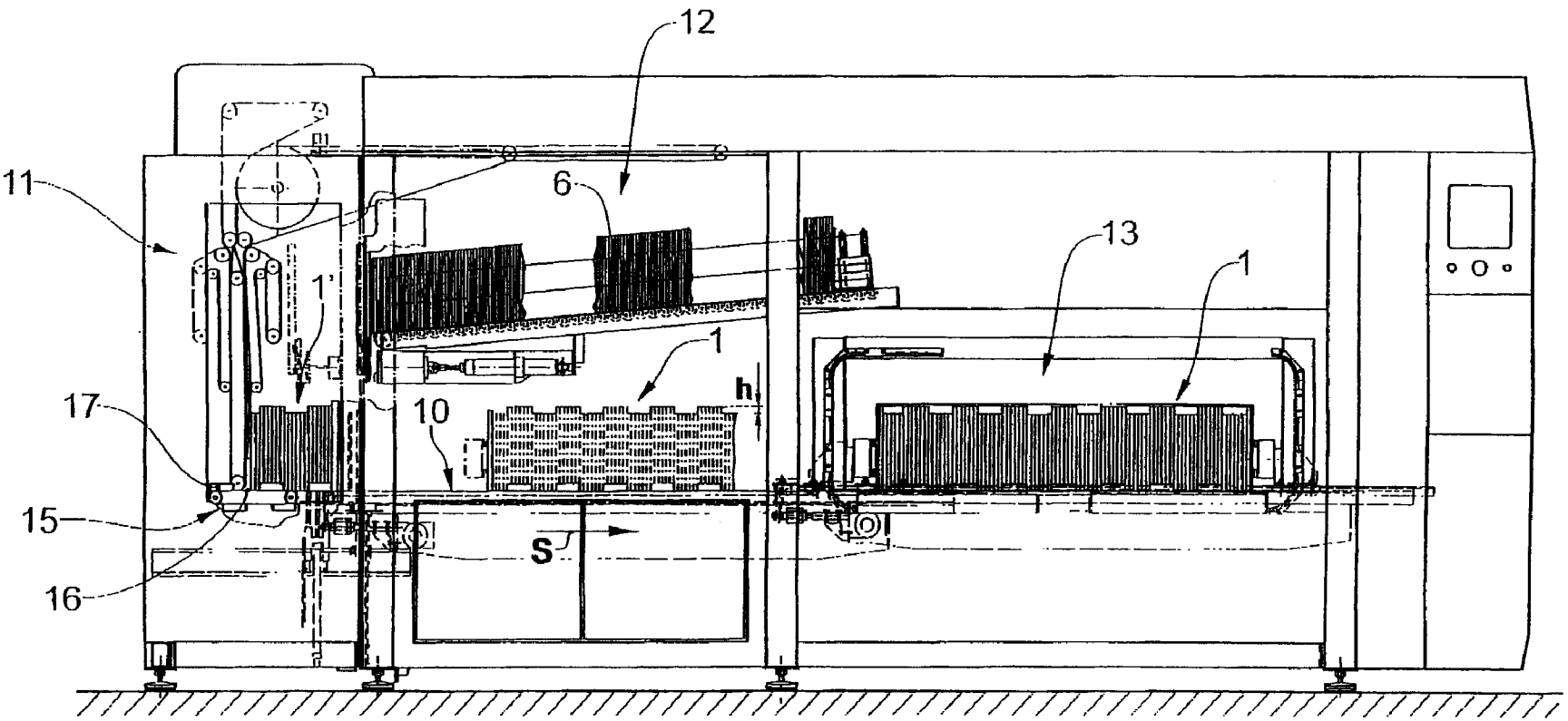
FIG. 3 shows an exemplified embodiment of the device for forming the stack-like arrangement according to the invention according to FIG. 1.

In the following the stack-like arrangements of rectangular printed products with one folded edge, the region of which is thicker or comprises thicker locations, due to a stapling, than other regions, as well as methods and devices for their forming are described. Hereby it goes without saying that the same stack-like arrangements, methods and devices are applicable for other flat objects with a first edge, in particular an edge with an edge region, which is thicker than other regions.

FIG. 1 shows an example of a stack-like arrangement 1 of printed products according to the invention, which substantially corresponds to a bar-like stack. Such a stack with horizontal stack orientation is formed by juxtaposing flat objects (in contrast to putting them on top of one another), for example. The printed products 2 are rectangular. They are e.g. doubly folded newspapers or stapled booklets (magazines or brochures). The printed products 2 are all orientated identically in the stack-like arrangement 1, wherein all edges 3 (folded edges) distinguished by their greater thickness are oriented downwards (or upwards). The stack-like arrangement 1 comprises a plurality of stack sections 4 and 4', wherein the printed products in each stack section are mutually aligned, wherein, however, every second stack section 4 is displaced in transverse to stack height H relatively to the other stack sections 4' such that the thicker edge regions 3 of each section 4 protrude from the stack-like arrangement, while for the other sections 4' the edge regions 3' opposite the thicker edge regions protrude.

Because the thicker edge regions only partly lie on top of each other they do not contribute to the stack height H in a complete manner and thus cannot destabilize the arrangement to a similar degree, as in a known stack, in which all printed products are identically aligned.

The stack-like arrangement according to FIG. 1 comprises, in a generally known manner, end plates 6 on its two ends and is strapped by a strapping tape. The end plates do not, as for known stacks of this kind (stacks formed by juxtaposing), have the same format as the printed products, but are larger by the displacement h of the stack section. Thus it is prevented that the regions of the printed products protruding on two mutually opposite sides of the arrangement are damaged by the strapping tape. It is naturally also possible to apply the strapping tape not in a plane in parallel to the displacement h of the stack section, as shown in FIG. 1, but vertically to it (indicated with broken lines in FIG. 1), such that the strapping tape is tensed over the stack sides out of which no stack sections protrude. A cross-wise double strapping or an arrangement of two or more than two parallel strappings is also conceivable.

FIG. 2 shows a side view of a detail of the stack-like arrangement 1 according to FIG. 1 at a larger scale. The stack-like arrangement 1 is shown on a conveying surface 10 (e.g. conveying belt) on which, when forming the arrangement the printed products are conveyed in a stacking direction S parallel to the stack height, wherein in the growing stack-like arrangement the printed products 2 are alternately mutually displaced by displacement h. In a feeding location, not shown in FIG. 2, the printed products are fed in a generally known manner e.g. from the top in a scaled stream with the folded edges downstream and deposited on the conveying surface 10. For the displacement of the stack sections in relation to one another a correspondingly controlled displacement means, not shown in FIG. 2, is used, with the aid of which the stack sections 4 and 4' are alternately deposited directly on the conveying surface 10 or, displaced by displacement h, over the conveying surface on a correspondingly shaped part of the displacement means. Exemplified embodiments of displacement means are described in context with FIGS. 3 through 6.

The stack sections of the stack-like arrangement shown in FIG. 2 are all of the same size. The stack sections 4 with protruding thicker edge regions 3 comprise more printed products than the stack sections 4' from which the edge regions 3' opposite the thicker edge regions 3 protrude. The stack sections 4' advantageously comprise only so many products that their thickness approximately corresponds to the additional thickness of the thicker edge regions of a section 4, such that the thicker edge regions of the printed products, which directly follow the stack sections 4' on both sides have the smallest possible distance from each other, thus substantially touch each other, as is shown in FIG. 2.

FIG. 3 shows an exemplified device for forming of stack-like arrangements according to FIG. 1. The device, apart from the displacement means, corresponds to the device described in publication EP-1523443 (or US-2005/0206063). Its known parts are thus only described in a very general manner here. Details may be taken from the named publications.

The device comprises a feeding means 11, with the help of which printed products are fed e.g. in a scaled stream onto the conveying surface 10 moving in stacking direction S and are, advantageously, with their ticker edge region forward, deposited on the conveying support, where they form a stack-like arrangement 1' growing in stacking direction S. The device is advantageously equipped with a not shown accelerating means, which makes sure that the stack-like arrangement is relatively loose in the region of the feeding location and is first driven in a stacking direction from the acceleration location distanced from the feeding location towards a counter support (not shown) arranged downstream. Thus a stack pressing is generated, such that the stacked printed products can no longer move in relation to one another, while the printed products between feeding location and accelerating location are still in a relatively loose succession and thus may still be aligned. From the growing and pressed arrangement discrete stack-like arrangements 1 are separated and further conveyed in stacking direction S. These stack-like arrangements are equipped with end plates 6 on their faces, for which purpose a plate positioning means 12 is provided. Then the stack-like arrangements 1 are strapped with the aid of a strapping tape in a strapping station 13 and removed from the device in transverse to the stacking direction, whereas the strapping station is not a necessary part of the device.

Unlike the device known from the publication named above, the device according to the invention according to FIG. 3 additionally comprises a displacement means 15 with which the fed printed products are alternately deposited in successive sections on the conveying surface 10 or above it by the intended displacement h.

The displacement means 15 shown in FIG. 3 comprises a revolvingly driven revolving organ 16 (e.g. chain or belt) on which displacement elements 17 are arranged at regular distances. The length of the displacement elements 17 in the revolving direction corresponds to the thickness of the sections 4' to be formed; the corresponding length of the distances between successive displacement elements 17 corresponds to the thickness of sections 4 to be formed. The displacement means is designed and arranged such that the displacement elements 17 are moved e.g. in a distance between two conveying belts forming the conveying surface 10, protruding over the conveying surface, at the same speed and in the same direction as the conveying surface 10 is moved through the feeding location and accompany the growing stack-like arrangement at least to directly after the accelerating location. Hereby the revolving organ is arranged such that its upper level is approximately at the height of the conveying surface 10 and the displacement elements are dimensioned such that their surface facing away from conveying surface 10 protrudes over the conveying surface 10 by the displacement h. All printed products, which are deposited on the conveying surface 10 form stack sections 4, all printed products, which are deposited on the displacement elements 17 form stack sections 4'.

Figure 4:
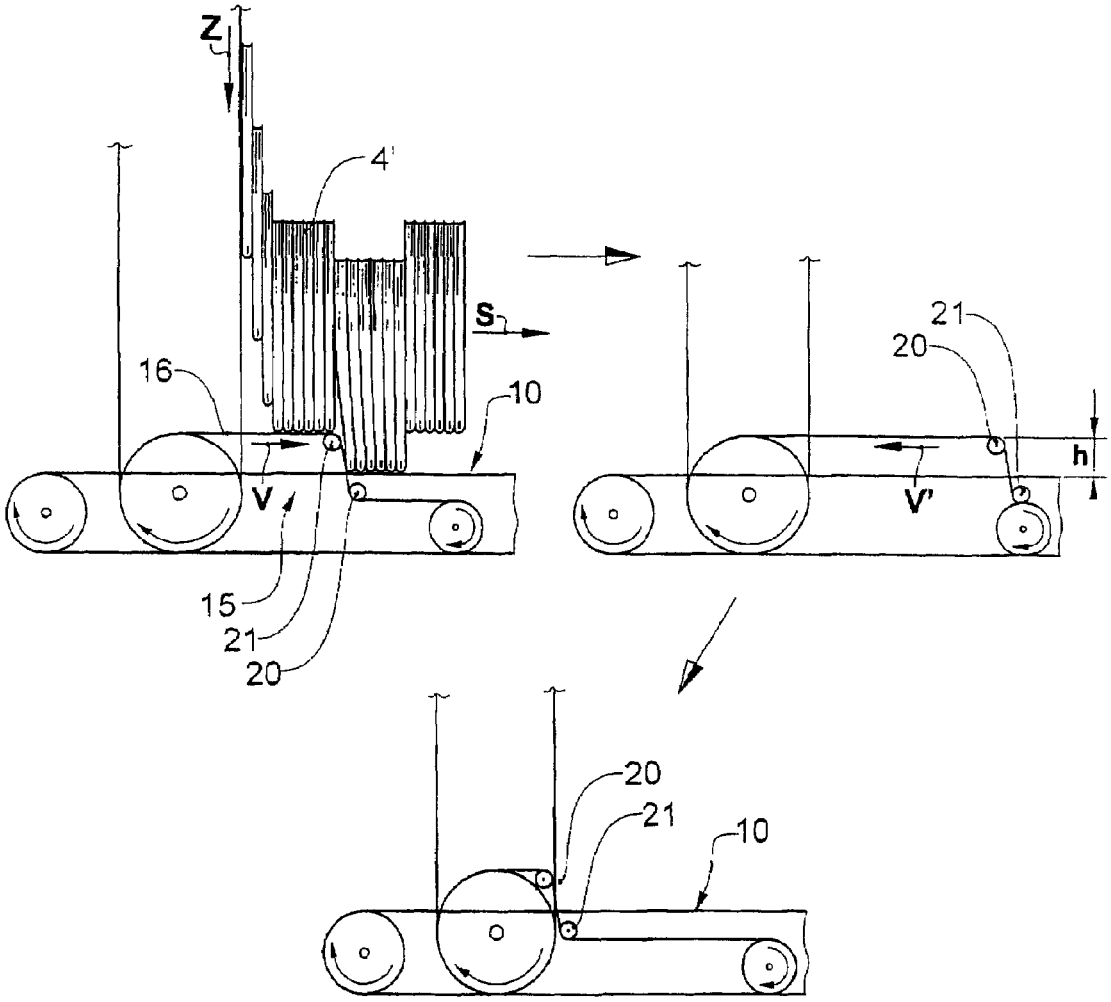
FIGS. 4, 5 show two exemplified embodiments of displacement means, which are suited to the device according to FIG. 3.
Figure 5:
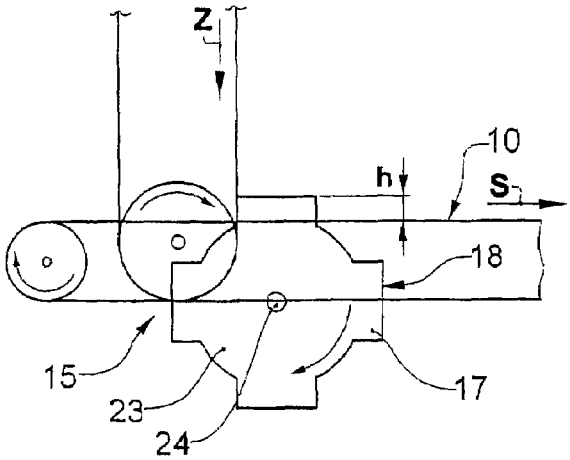

FIGS. 4 and 5 show further displacement means 15, which are suited to a device for forming of stack-like arrangements according to the invention, the stacking direction S or the stack height respectively being aligned approximately in horizontal and the printed products being conveyed from above (feeding direction Z) into the feeding location, as is the case in the device according to FIG. 3. As the displacement means 15 shown in FIGS. 4 and 5 cannot accompany the growing stack-like arrangement further than by the thickness of a section, they are better suited for devices, in which the growing stack-like arrangement is pressed from the feeding location onwards, i.e. for devices which do not comprise the above mentioned acceleration means distanced from the feeding location according to publication EP-1523443 (or US-2005/0206063).

The displacement means 15 according to FIG. 4 again comprises a revolvingly driven revolving organ 16, which is e.g. arranged between two conveying belts forming the conveying surface 10 and which gradually runs over two deflection rollers 20 and 21, such that it runs in conveying direction after the step below the conveying surface 10 or on the same level and upstream from the step over the conveying surface by the displacement h. The two deflection rollers 20 and 21 are movable to and fro (arrows V and V') together in parallel to the stacking direction S by means of suitable means (not shown), such that the step is optionally behind the feeding location or moves away from the feeding location in stacking direction S or against the stacking direction S towards the feeding location.

FIG. 4 shows the displacement means 15 in three successive phases of the forming of a stack-like arrangement according to the invention: on the left, when forming a section 4' (printed products are deposited on the step, i.e. by displacement h over the conveying surface 10), while the deflection rollers 20 and 21 move at approximately the same speed as the conveying surface moves in stacking direction S (arrow V); then on the right, directly before the beginning of the forming of a section 4 succeeding section 4', before which the deflection rollers are moved at an increased speed in the opposite direction (arrow V') behind the feeding location; finally bottom right during the forming of a section 4 (printed products are deposited onto the conveying surface), during which the deflection rollers 20 and 21 are positioned behind the feeding location in a stationary manner.

The displacement means according to FIG. 5 is similar to the displacement means according to FIG. 3, wherein, however, the displacement elements 17 are not arranged on a revolving organ but on a rotationally driven wheel 23. The wheel 23 is arranged to rotate around an axis 24, wherein the axis 24 is arranged below the conveying surface 10 and in transverse to the stacking direction S. The wheel 23 comprises e.g. regularly distributed on its circumference, four mutually distanced displacement elements 17, which protrude from the wheel circumference and comprise outer surfaces 18, which are approximately plane. The wheel 23 is e.g. arranged at a distance between two conveying belts forming the conveying surface 10, such that a displacement element 17, which is at the upper zenith of the wheel 23, protrudes by the displacement h over the conveying surface and that the circumference of the wheel 23 lies under the conveying surface 10, when no displacement element 17 is positioned on the upper zenith of the wheel 23.

Other displacement means, e.g. a pusher, slider, are also possible.

Figure 6:
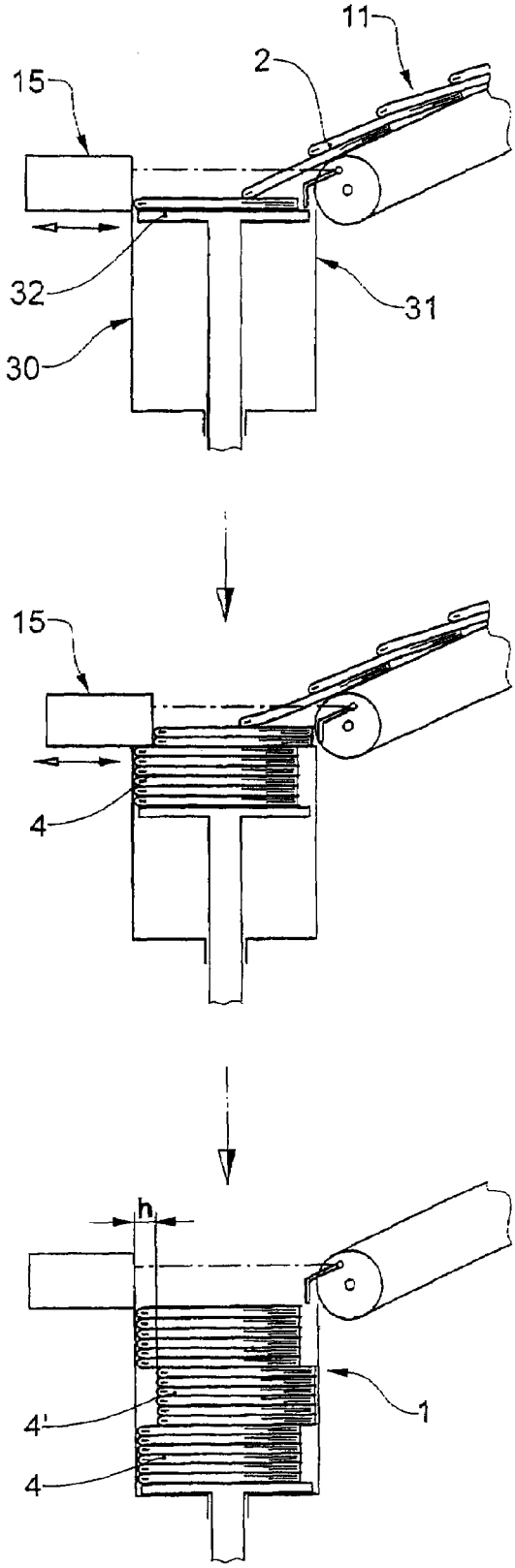
FIG. 6 shows a further exemplified embodiment of the device for forming the stack-like arrangement according to the invention.

FIG. 6 shows, that unlike in FIGS. 2 to 5, in which stack forming with horizontally aligned stack height is shown, it is also possible to form stack-like arrangements according to the invention with vertical stack height. A device used for this comprises, like known devices for forming of stacks with vertical stack height, a stacking shaft 30 and a feeding means 11 for feeding of printed products 2 towards the top open end of the stacking shaft 30. The feeding means 11, which is e.g. designed as a conveying belt, leads the printed products 2 from top right to a feeding side 31 of the open top end of the stacking shaft 30 and conveys them over the shaft opening, from where they are moved onto a stacking table 32 moved downwards during the stacking or onto printed products already stacked on the stacking table 32. The feeding of the printed products is carried out at such a speed, that the printed products butt the side opposite the feeding side and thus are aligned to this side.

For forming of stack-like arrangements 1 according to the invention the distance between the feeding side of the stacking shaft 30 and the opposite side is larger by at least the displacement h than the corresponding dimension of the printed product. Furthermore a displacement means 15 movable to and fro by the intended displacement h is provided, which, depending on the section (4 and 4') which is being stacked, is pushed forward into the stacking shaft 30 or correspondingly withdrawn. Advantageously the displacement means 15 comprises two parts, a first part, which is arranged on the side opposite the feeding side and a second part, which is arranged on the feeding side, as shown in FIG. 6.

FIG. 6 shows the device in three succeeding phases of a stack formation. The printed products 2 are e.g. fed with the folded edges up front in a scaled stream, in which the downstream folded edges lie on top. On the left the beginning of the stacking with the completely raised stacking table 32 is shown. The displacement means 15 is reversed, the stack section to be formed is a section 4 (when stacking with downstream folded edges). When the stack section 4 has a sufficient thickness, the displacement means is moved into the stacking shaft, as shown in FIG. 6. By means of a corresponding to and fro movement of the displacement means 15 stack sections 4 and 4' are alternately formed in the stacking shaft, until the stacking table 32 has reached its bottommost position and the finished stack-like arrangement can be removed from the stacking shaft 30, which advantageously happens in transverse to the feeding direction.

The invention claimed is:

1. A method for forming a stack-like arrangement from a plurality of flat objects, wherein each of the plurality of flat objects comprises a first edge and a second edge opposite the first edge, the method comprising the steps of:

feeding the flat objects with their first edges in identical orientation;

arranging the flat objects in a stack-like arrangement substantially transverse to a substantially horizontal stacking direction and parallel to each other and adjacent to each other;

feeding the flat objects, in a feeding location, to a feeding-side-end of the stack-like arrangement from the top;

depositing the flat objects on a substantially horizontal conveying surface or on a displacement element protruding over the conveying surface, and thereby alternately adding stack sections, which each comprise at least one of the fed flat objects and for added stack sections which comprise two or more fed flat objects have the first edges of such two or more fed flat objects lie on top of each other, with protruding first edges and stack sections with protruding second edges to the stack-like arrangement and forming a displacement between these alternate stack sections, which is oriented perpendicular to the conveying surface, and conveying away the stack-like arrangements.

2. The method according to claim 1, wherein the flat objects are printed products and the first edges are folded edges.

3. The method according to claim 1, further comprising the step of conveying the stack-like arrangement during its formation in the stacking direction.

4. The method according to claim 1, further comprising the step of moving a plurality of displacement elements, which protrude over the conveying surface and are distanced from one another, with the same conveying velocity and conveying direction as the conveying surface, such that they accompany the growing stack-like arrangement.

5. The method according to claim 1, further comprising the step of feeding the objects in a relatively loose succession at the feeding location and driving them towards a counter support from an acceleration location, which is arranged at a distance from the feeding location, in order to generate a stack pressing.

6. The method according to claim 5, further comprising the step of aligning the objects between the feeding location and the acceleration location.

7. The method according to claim 1, further comprising the step of strapping the stack-like arrangement.

8. The method according to claim 1, further comprising the step of arranging end plates on end faces of the stack-like arrangement, wherein the end plates comprise a shape and a size, which is larger than the shape and the size of the flat objects at least by the dimension of a displacement of the stack sections with respect to one another.

9. The method according to claim 1, wherein the flat objects have a thickness that is larger in one edge region of the first edge than in other regions of the flat object.

10. The method according to claim 1, wherein all stack sections are formed with an equal number of flat objects.

11. The method according to claim 1, wherein the stack sections in which the second edges protrude comprise less flat objects than the stack sections in which the first edges protrude.

12. The method according to claim 1, wherein the flat objects are printed products.

13. The method according to claim 12, wherein the first edge is a folded edge of a folded or stapled printed product.

14. The method according to claim 12, wherein the flat objects are at least one of doubly folded newspapers, stapled tabloids, not stapled tabloids, magazines, and brochures.

15. A device for forming stack-like arrangements of flat objects, wherein each of the plurality of flat objects comprises a first edge and a second edge opposite the first edge, the device comprising:

a feeder for feeding the flat objects with identical orientation of the first edge, a stacker for arranging the fed flat objects in a stack-like arrangement substantially in transverse to a stacking direction in parallel to each other and adjacent to each other on a substantially horizontal conveying surface, and a movable displacement unit for forming, on a feeding-side-end of the stack-like arrangement, added stack sections, which each comprise at least one of the fed objects, the first edges of which lie on top of each other, in relation to each other transverse to the stack height and transverse to the first edges, and thereby alternately adding stack sections with protruding first edges and stack sections with protruding second edges to the stack-like arrangement, and a conveyor for conveying away the stack-like arrangements wherein the feeder is equipped for feeding the flat objects from the top and depositing the flat objects in a feeding location on the conveying surface, and wherein the displacement means comprises at least one displacement element, which, in the feeding location, alternately protrudes over the conveying surface, or does not protrude.

16. The device according to claim 15, wherein the displacement means comprises a plurality of mutually distanced revolving displacement elements.

17. The device according to claim 15, wherein the displacement means comprises a step, which is displaceable in the stacking direction.

* * * * *